US007631631B2

(12) United States Patent
Neal et al.

(10) Patent No.: US 7,631,631 B2
(45) Date of Patent: Dec. 15, 2009

(54) OIL COMMUNICATION MANIFOLD FOR AN INTERNAL COMBUSTION ENGINE

(75) Inventors: Timothy L Neal, Ortonville, MI (US); Joseph J Moon, Clawson, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 117 days.

(21) Appl. No.: 11/832,324

(22) Filed: Aug. 1, 2007

(65) Prior Publication Data

US 2009/0031982 A1 Feb. 5, 2009

(51) Int. Cl.
*F01L 1/34* (2006.01)

(52) U.S. Cl. ..... 123/198 F

(58) Field of Classification Search ..... 123/198 F, 123/90.12, 90.13

See application file for complete search history.

(56) References Cited

U.S. PATENT DOCUMENTS 4,627,391 A * 12/1986 Derringer ..... 123/90.16
5,701,857 A * 12/1997 Hara ..... 123/90.16
6,557,518 B1 * 5/2003 Albertson et al. ..... 123/198 F
6,584,951 B1 * 7/2003 Patel et al. ..... 123/198 F
7,040,265 B2 * 5/2006 Falkowski et al. ..... 123/90.16

* cited by examiner

*Primary Examiner*—M. McMahon

(57) ABSTRACT

A cylinder head assembly for an internal combustion engine is provided having a cylinder head adapted to contain at least one switchable valvetrain element operable to selectively deactivate at least one intake valve and at least one other switchable valvetrain element operable to selectively deactivate at least one exhaust valve. The cylinder head defines at least one feed passage operable to selectively communicate fluid pressure to the at least one switchable valvetrain element to selectively deactivate the at least one intake valve. The cylinder head defines at least one other feed passage operable to selectively communicate fluid pressure to the at least one other switchable valvetrain element to selectively deactivate the at least one exhaust valve. An oil communication manifold is mounted to the head and defines at least one communication passage operable to enable communication of fluid pressure between the at least one feed passage and the at least one other feed passage.

8 Claims, 3 Drawing Sheets

OIL COMMUNICATION MANIFOLD FOR AN INTERNAL COMBUSTION ENGINE

TECHNICAL FIELD

The present invention relates to an oil communication manifold for use with an overhead cam internal combustion engine having variable displacement operability.

BACKGROUND OF THE INVENTION

Variable displacement internal combustion engines provide for improved fuel economy and torque on demand by operating on the principal of cylinder deactivation, sometimes referred to as Active Fuel Management or Displacement on Demand. During operating conditions that require high output torque, every cylinder of a variable displacement internal combustion engine is supplied with fuel and air (also spark, in the case of a gasoline internal combustion engine) thereby enabling the internal combustion engine to provide the required torque. During operating conditions at low speed, low load and/or other inefficient conditions for a variable displacement internal combustion engine, cylinders may be deactivated to improve fuel economy for the variable displacement internal combustion engine and vehicle. For example, in the operation of a vehicle equipped with an eight cylinder internal combustion engine, fuel economy will be improved by reducing throttling losses if the internal combustion engine is operated with only four cylinders during low torque operating conditions. Throttling losses, also known as pumping losses, are the extra work that an internal combustion engine must perform to pump air around the restriction of a relatively closed throttle plate and pump air from the relatively low pressure of an intake manifold through the internal combustion engine and out to the atmosphere. The cylinders that are deactivated will disallow the flow of air through their intake and exhaust valves, reducing pumping losses by forcing the internal combustion engine to operate at a higher throttle plate angle and a higher intake manifold pressure. The deactivation of the cylinders may be accomplished by disabling or deactivating the intake and exhaust valves associated with the cylinder to be deactivated. Since the deactivated cylinders do not allow air to flow, additional losses are avoided by operating the deactivated cylinders as "air springs" due to the compression and decompression of the air in each deactivated cylinder.

SUMMARY OF THE INVENTION

A cylinder head assembly for an internal combustion engine is provided having a cylinder head adapted to contain at least one switchable valvetrain element operable to selectively deactivate at least one intake valve and at least one other switchable valvetrain element operable to selectively deactivate at least one exhaust valve. The cylinder head defines at least one feed passage operable to selectively communicate fluid pressure to the at least one switchable valvetrain element to selectively deactivate the at least one intake valve. The cylinder head defines at least one other feed passage operable to selectively communicate fluid pressure to the at least one other switchable valvetrain element to selectively deactivate the at least one exhaust valve. An oil communication manifold is mounted to the cylinder head and defines at least one communication passage operable to enable communication of fluid pressure between the at least one feed passage and the at least one other feed passage.

In one embodiment, the cylinder head has a four valve-per-cylinder configuration. A control valve may be provided that is operable to vary fluid pressure within the at least one communication passage, the at least one feed passage, and the at least one other feed passage. The communication manifold may be mounted to the cylinder head by at least one banjo fitting. The at least one banjo fitting is operable to enable communication between the at least one communication passage and one of the at least one feed passage and the at least one other feed passage.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
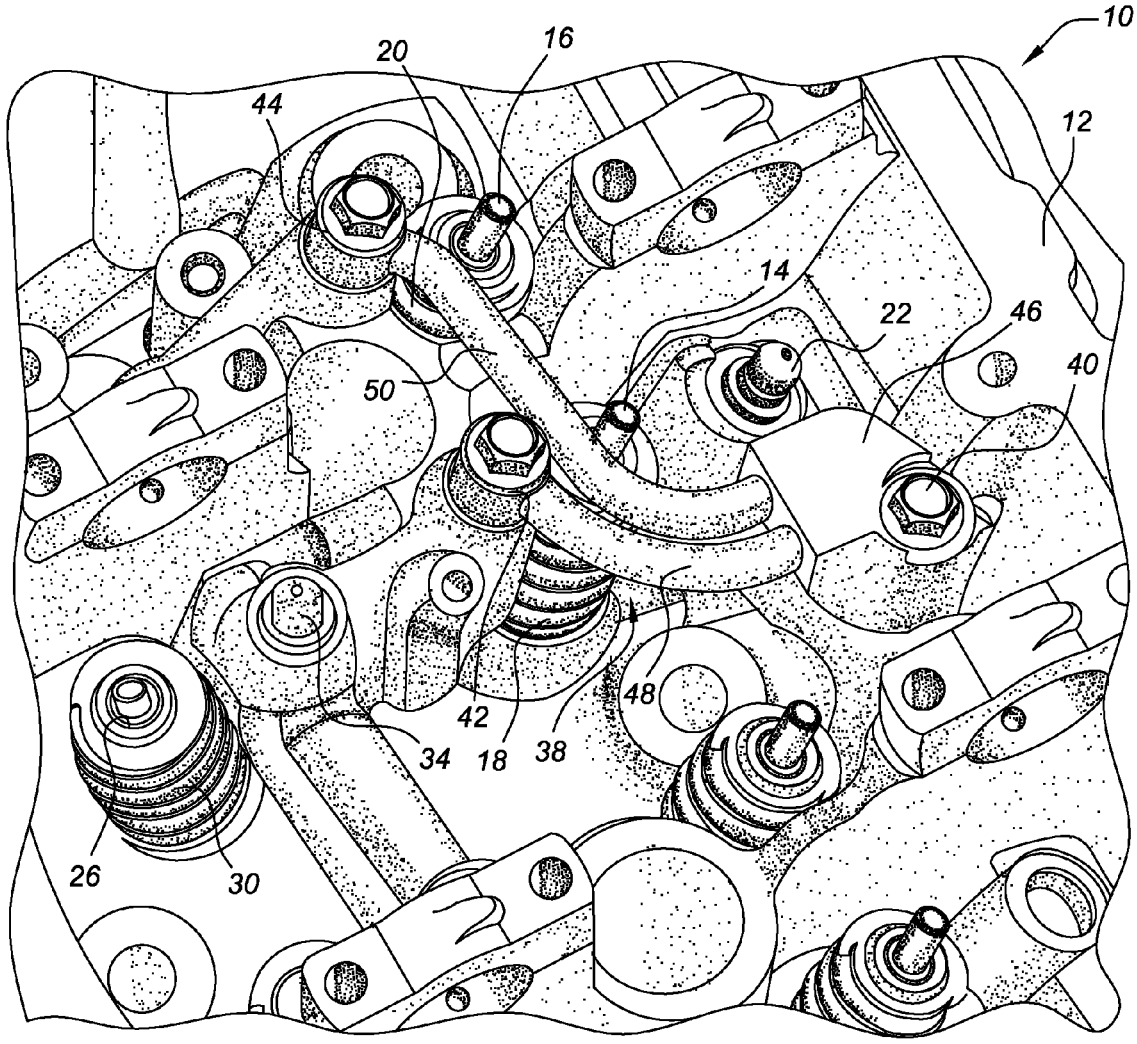
FIG. 1 is a perspective view of a portion of a cylinder head assembly including a cylinder head adapted to be mounted on an internal combustion engine.

Referring to the drawings wherein like reference numbers correspond to like or similar components throughout the several figures, there is shown in FIG. 1 a cylinder head assembly, generally indicated at 10. The cylinder head assembly 10 includes a cylinder head 12 which is preferably formed from cast metal, such as aluminum or iron. The cylinder head 12 is adapted to be mountable to a variable displacement internal combustion engine, not shown. Those skilled in the art will recognize that internal combustion engines possessing variable displacement functionality are operable in an activated state wherein all cylinders of the internal combustion engine receive intake air and fuel for combustion therein and in a deactivated state wherein at least one of the cylinders will not receive intake air and fuel thereby preventing combustion within the deactivated cylinder. Cylinder deactivation is typically accomplished by preventing the opening of the intake and exhaust valves associated with the deactivated cylinder.

The cylinder head assembly 10 further includes first and second intake valves 14 and 16, respectively. The first and second intake valves 14 and 16 are translatable within the cylinder head 12 and cooperate to selectively introduce intake air or an intake air and fuel mixture into the internal combustion engine for combustion therein. The first and second intake valves 14 and 16 are biased toward a closed position by respective first and second valve springs 18 and 20. The lash or clearance between the first and second intake valves 14 and 16 and associated rocker arms or followers, not shown, is accounted for by a respective first switchable valvetrain element 22 and a second switchable valvetrain element 24, shown in FIG. 3. The first and second switchable valvetrain elements 22 and 24 may be characterized as "switching" lash adjusters in that they are operable to communicate fluid pressure to the associated followers to effect deactivation of the first and second intake valves 14 and 16.

The cylinder head assembly 10 includes first and second exhaust valves 26 and 28 (shown in FIG. 2), respectively. The first and second exhaust valves 26 and 28 are translatable within the cylinder head 12 and cooperate to selectively exhaust products of combustion from the internal combustion engine. The first and second exhaust valves 26 and 28 are biased toward a closed position by respective third and fourth valve springs 30 and 32 (shown in FIG. 2). The lash or clearance between the first and second exhaust valves 26 and 28 and associated rocker arms or followers, not shown, is accounted for by a respective third switchable valvetrain element 34 and a fourth switchable valvetrain element 36, shown in FIG. 2. The third and fourth switchable valvetrain elements 34 and 36 may be characterized as "switching" lash adjusters in that they are operable to communicate fluid pressure to the associated followers to effect deactivation of the first and second exhaust valves 26 and 28.

An oil communication manifold 38 is mounted to the cylinder head 12 and is operable to communicate fluid pressure to the third and fourth switchable valvetrain elements 34 and 36 to effect the deactivation of the first and second exhaust valves 26 and 28. The oil communication manifold 38 is mounted to the cylinder head 12 by a fastener 40 and first and second banjo fittings 42 and 44. The oil communication manifold 38 includes a block member 46 having first and second tube members 48 and 50 extending therefrom. The first and second tube members 48 and 50 are affixed to the block member 46 by fastening means, such as brazing, interference fit, adhesive bonding, and welding.

Figure 2:
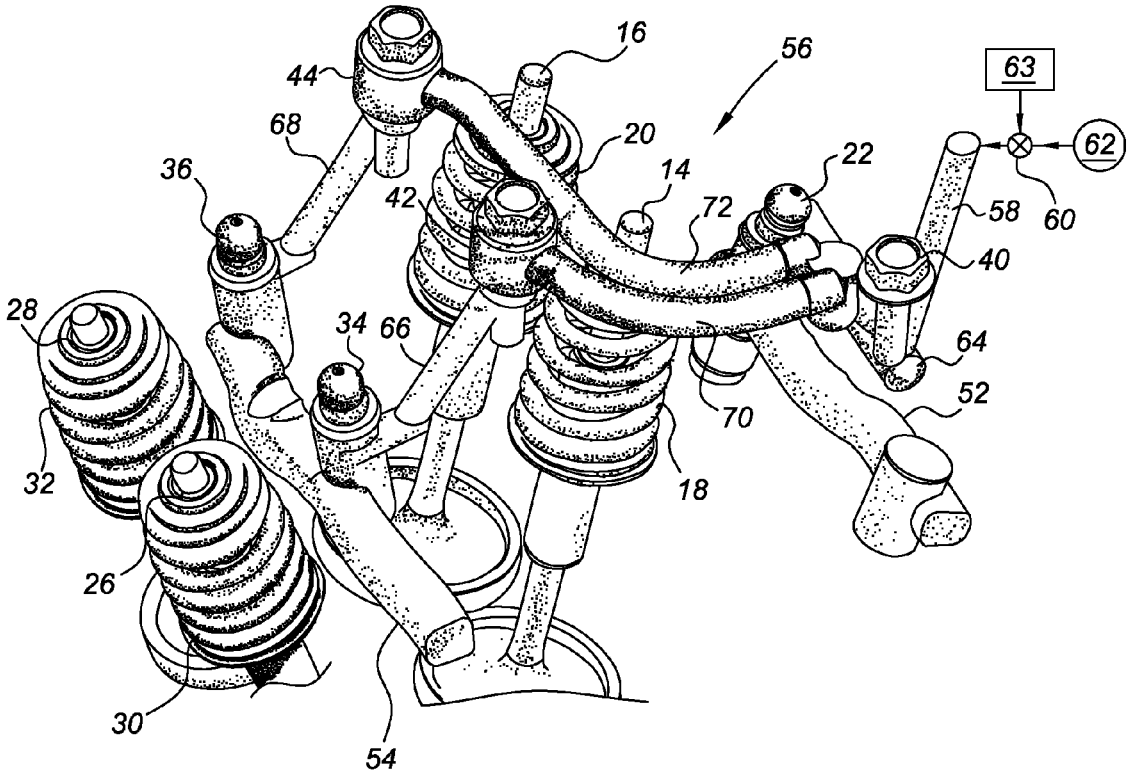
FIG. 2 is a perspective view of internal passages defined by the cylinder head and an oil communication manifold that comprise a cylinder deactivation circuit.

Referring to FIG. 2 and with continued reference to FIG. 1, there is shown a perspective view of the internal fluid passages defined by the cylinder head 12 and the oil communication manifold 38 and configured to form a cylinder deactivation fluid circuit 56. The cylinder head 12 defines first and second lubrication passages 52 and 54, respectively. The first lubrication passage 52 is operable to communicate oil to the first and second switchable valvetrain elements 22 and 24, while the second lubrication passage 54 is operable to communicate oil to the third and fourth switchable valvetrain elements 34 and 36. The cylinder head 12 and oil communication manifold 38 cooperate to form the cylinder deactivation fluid circuit 56 operable to selectively deactivate the first and second intake valves 14 and 16 and the first and second exhaust valves 26 and 28.

The cylinder deactivation fluid circuit 56 includes a supply passage 58, defined by the cylinder head 12, which is selectively provided with fluid pressure by a control valve 60 in communication with a pressurized fluid source 62. The control valve 60 is preferably a solenoid operated valve which receives command signals from a controller 63. The supply passage 58 is in communication with a feed passage 64 which is defined by the cylinder head 12. The feed passage 64 is operable to provide the first and second switchable valvetrain elements 22 and 24 with fluid pressure to effect the switching of followers, not shown, associated therewith. The cylinder head 12 further defines feed passages 66 and 68. The feed passages 66 and 68 are operable to provide respective third and fourth switchable valvetrain elements 34 and 36 with fluid pressure to effect the switching of followers, not shown, associated therewith. Fluid communication passages 70 and 72 are defined by the respective first and second tube members 48 and 50 of the oil control manifold 38, shown in FIG. 1, and are operable to provide communication between the feed passage 64 and the feed passages 66 and 68. The first banjo fitting 42 is operable to provide communication between the communication passage 70 and the feed passage 66, while second banjo fitting 44 is operable to provide communication between the communication passage 72 and the feed passage 68.

During operation, the controller 63 will command the control valve 60 to selectively communicate fluid pressure from the pressurized fluid source 62 to the supply passage 58. Subsequently, the fluid pressure is communicated from the supply passage 58 to the feed passage 64 to effect switching of the first and second switchable valvetrain elements 22 and 24 thereby deactivating the respective first and second intake valve 14 and 16. Additionally, fluid pressure is communicated from the feed passage 64 to the feed passages 66 and 68 via the communication passages 70 and 72. The feed passages 66 and 68 subsequently the third and fourth switchable valvetrain elements 34 and 36 with fluid pressure to enable switching thereby deactivating the first and second exhaust valves 26 and 28.

Figure 3:
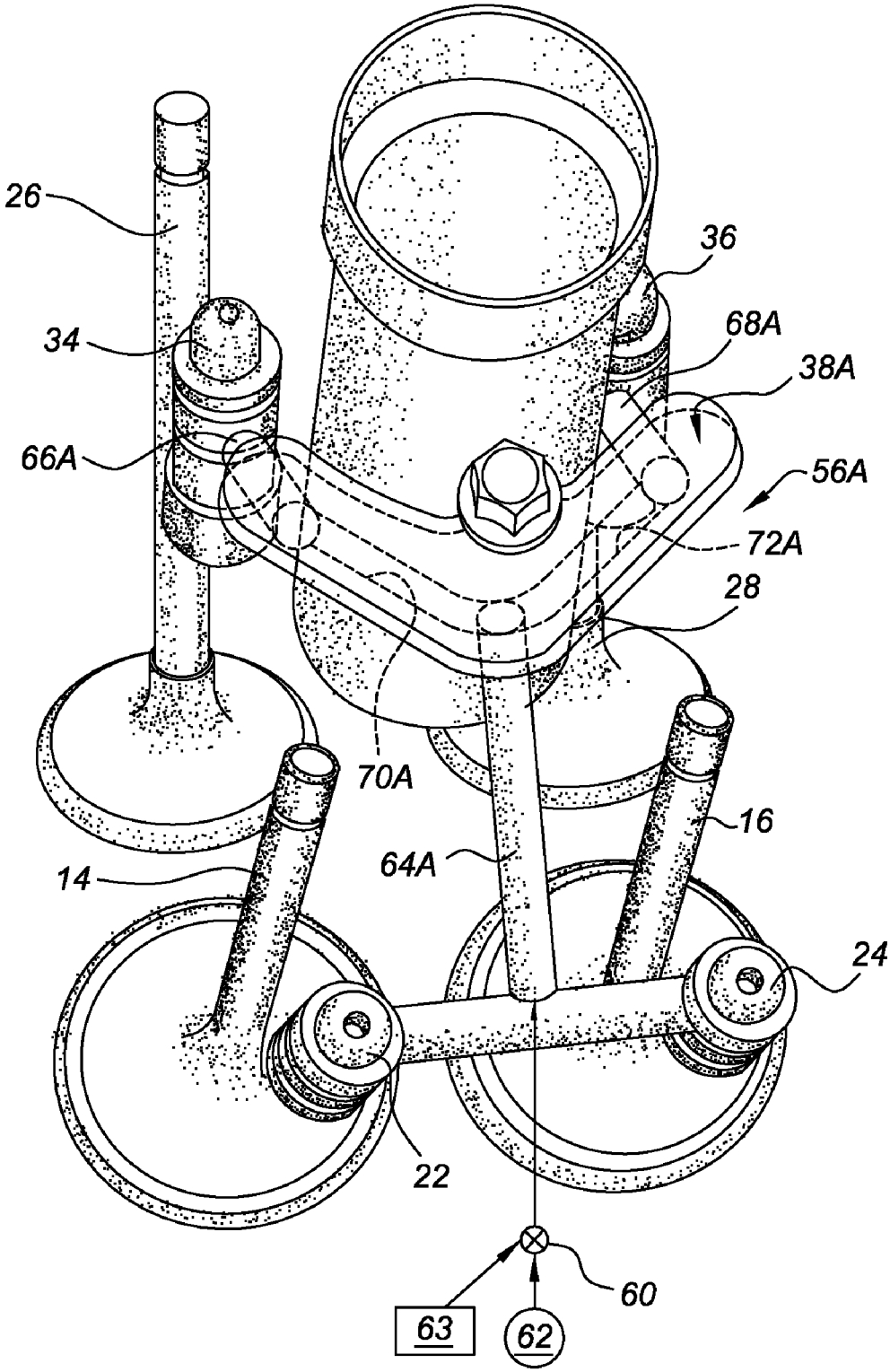
FIG. 3 is a perspective view of an alternate embodiment of the cylinder deactivation circuit of FIG. 2.

Referring to FIG. 3, there is shown an alternate embodiment of the cylinder deactivation fluid circuit 56 of FIG. 2, generally indicated at 56A. The cylinder deactivation fluid circuit 56 includes feed passage 64A operable to provide fluid pressure from the control valve 60 to the first and second switchable valvetrain elements 22 and 24. Additionally, the feed passage 64A is operable to communicate fluid pressure to an oil communication manifold 38A. The oil communication manifold 38A defines first and second communication passages 70A and 72A, respectively. The first and second communication passages 70A and 72A are illustrated in FIG. 3 as dashed lines and are operable to communicate fluid pressure from the feed passage 64A to respective feed passages 66A and 68A. By providing fluid pressure to the feed passages 64A, 66A, and 68A the first, second, third, and fourth switchable valvetrain elements 22, 24, 34, and 36 will enable deactivation of the respective first and second intake valves 14 and 16 and the first and second exhaust valves 26 and 28.

The oil communication manifolds 38 and 38A enable the use of a single control valve 60 to deactivate both the first and second intake valves 14 and 16 as well as the first and second exhaust valves 26 and 28 thereby simplifying the cylinder deactivation fluid circuits 56 and 56A. Although the forgoing discussion has focused on a single cylinder of a multi cylinder engine, those skilled in the art will recognize that the cylinder deactivation fluid circuit 56 of FIG. 2 and the cylinder deactivation fluid circuit 56A of FIG. 3 may be used on additional cylinders of a multi-cylinder engine while remaining within the scope of that which is claimed. Additionally the cylinder deactivation fluid circuits 56 and 56A may be used in conjunction with two-step followers thereby enabling two distinct valve lift profiles in lieu of selective deactivation if the first and second intake valves 14 and 16 and the first and second exhaust valves 26 and 28.

Those skilled in the art will recognize that the first, second, third, and fourth switchable valvetrain element 22, 24, 34, and 36, referred to herinabove, may be a switchable follower or a stationary lash adjuster while remaining within the scope of that which is claimed. While the best modes for carrying out the invention have been described in detail, those familiar with the art to which this invention relates will recognize various alternative designs and embodiments for practicing the invention within the scope of the appended claims.

The invention claimed is:

1. A cylinder head assembly for a variable displacement internal combustion engine comprising:

a cylinder head adapted to contain at least one switchable valvetrain element operable to selectively deactivate at least one intake valve and at least one other switchable valvetrain element operable to selectively deactivate at least one exhaust valve;

wherein said cylinder head defines at least one feed passage operable to selectively communicate fluid pressure to said at least one switchable valvetrain element to selectively deactivate said at least one intake valve;

wherein said cylinder head defines at least one other feed passage operable to selectively communicate fluid pressure to said at least one other switchable valvetrain element to selectively deactivate said at least one exhaust valve; and an oil communication manifold mounted to said cylinder head and defining at least one communication passage operable to enable communication of fluid pressure between said at least one feed passage and said at least one other feed passage;

wherein said oil communication manifold is mounted to said cylinder head by at least one banjo fitting and wherein said at least one banjo fitting is operable to enable communication of fluid pressure between said at least one communication passage and one of said at least one feed passage and said at least one other feed passage.

2. The cylinder head assembly of claim 1, wherein said cylinder head has a four valve-per-cylinder configuration.

3. The cylinder head assembly of claim 1, further comprising a control valve operable to vary fluid pressure within said at least one communication passage, said at least one feed passage, and said at least one other feed passage.

4. A cylinder head assembly for an internal combustion engine comprising:

a cylinder head adapted to contain at least one switchable valvetrain element operable to selectively deactivate at least one intake valve and at least two other switchable valvetrain elements each operable to selectively deactivate respective first and second exhaust valves;

wherein said cylinder head defines at least one feed passage operable to selectively communicate fluid pressure to said at least one switchable valvetrain element to selectively deactivate said at least one intake valve;

wherein said cylinder head defines at least two other feed passages each operable to selectively communicate fluid pressure to a respective one of said at least two other switchable valvetrain elements to selectively deactivate said first and second exhaust valves; and an oil communication manifold mounted to said cylinder head and defining first and second communication passages operable to enable communication of fluid pressure between said at least one feed passage and said at least two other feed passages;

first and second banjo fittings operable to mount said oil communication manifold to said cylinder head;

wherein said first banjo fitting is operable to enable communication of fluid pressure between said first communication passage and one of said at least two other feed passages; and wherein said second banjo fitting is operable to enable communication of fluid pressure between said second communication passage and another of said at least two feed passages.

5. The cylinder head assembly of claim 4, wherein said cylinder head has a four valve-per-cylinder configuration.

6. The cylinder head assembly of claim 4, further comprising a control valve operable to vary fluid pressure within said first and second communication passages, said at least one feed passage, and said at least two other feed passages.

7. A cylinder head assembly for a variable displacement internal combustion engine, the cylinder head assembly comprising:

a cylinder head adapted to contain first and second switchable valvetrain elements operable to selectively deactivate respective first and second intake valves and third and fourth switchable valvetrain elements operable to selectively deactivate respective first and second exhaust valves;

wherein said cylinder head defines at least one feed passage operable to selectively communicate fluid pressure to said first and second switchable valvetrain elements to selectively deactivate said first and second intake valves;

wherein said cylinder head defines at least two other feed passages each operable to selectively communicate fluid pressure to a respective one of said first and second switchable valvetrain elements to selectively deactivate said first and second exhaust valves; and an oil communication manifold mounted to said cylinder head and defining first and second communication passages operable to enable communication of fluid pressure between said at least one feed passage and said at least two other feed passages;

first and second banjo fittings operable to mount said oil communication manifold to said cylinder head;

wherein said first banjo fitting is operable to enable communication of fluid pressure between said first communication passage and a first of said at least two other feed passages; and wherein said second banjo fitting is operable to enable communication of fluid pressure between said second communication passage and a second of said at least two other feed passages.

8. The cylinder head assembly of claim 7, further comprising a control valve operable to vary fluid pressure within said first and second communication passages, said at least one feed passage, and said at least two other feed passages.

* * * * *